US007386978B2

(12) United States Patent
Ivantysynova et al.

(10) Patent No.: US 7,386,978 B2
(45) Date of Patent: Jun. 17, 2008

(54) METHOD FOR CONTROLLING A HYDRAULIC SYSTEM OF A MOBILE WORKING MACHINE

(75) Inventors: Monika Ivantysynova, West Lafayette, IN (US); Robert Rahmfeld, Hamburg (DE); Jürgen Weber, Dresden (DE)

(73) Assignee: CNH America LLC, New Holland, PA (US)

( * ) Notice: Subject to any disclaimer, the term of this patent is extended or adjusted under 35 U.S.C. 154(b) by 176 days.

(21) Appl. No.: 10/544,155

(22) PCT Filed: Feb. 4, 2004

(86) PCT No.: PCT/DE2004/000180

§ 371 (c)(1),
(2), (4) Date: Feb. 23, 2006

(87) PCT Pub. No.: WO2004/074686

PCT Pub. Date: Sep. 2, 2004

(65) Prior Publication Data

US 2006/0182636 A1 Aug. 17, 2006

(30) Foreign Application Priority Data

Feb. 20, 2003 (DE) ..... 103 07 190

(51) Int. Cl.
*F04B 49/06* (2006.01)
*F16H 61/46* (2006.01)

(52) U.S. Cl. ..... 60/434; 60/449; 60/452; 60/486

(58) Field of Classification Search ..... 60/431, 60/434, 449, 452, 486
See application file for complete search history.

(56) References Cited

U.S. PATENT DOCUMENTS

| | | | | |
|---|---|---|---|---|
| 4,606,313 | A * | 8/1986 | Izumi et al. | 60/434 |
| 4,904,161 | A * | 2/1990 | Kamide et al. | 60/434 |
| 5,155,996 | A * | 10/1992 | Tatsumi et al. | 60/431 |
| 5,303,551 | A * | 4/1994 | Lee | 60/431 |
| 5,527,156 | A * | 6/1996 | Song | 60/449 |
| 5,875,630 | A * | 3/1999 | Walsh et al. | 60/449 |
| 5,944,492 | A * | 8/1999 | Konishi et al. | 60/449 |
| 6,823,672 | B2 * | 11/2004 | Nakamura | 60/449 |

FOREIGN PATENT DOCUMENTS

| | | |
|---|---|---|
| DE | 198 25 759 A | 2/1999 |
| DE | 199 53 170 A | 5/2001 |
| DE | 101 28 584 A | 12/2002 |
| EP | 0 277 253 B | 7/1992 |
| EP | 0 497 293 A | 8/1992 |
| GB | 1 102 902 A | 2/1968 |

* cited by examiner

*Primary Examiner*—Thomas E Lazo
(74) *Attorney, Agent, or Firm*—Patrick M. Sheldrake; John William Stader; Michael G. Harms

(57) ABSTRACT

A method is described for controlling a hydraulic system, particularly of mobile working machine, with at least one internal combustion engine driving at least one hydraulic pump with adjustable volumetric displacement and possibly additional fixed-displacement pumps.

10 Claims, 2 Drawing Sheets

METHOD FOR CONTROLLING A HYDRAULIC SYSTEM OF A MOBILE WORKING MACHINE

FIELD OF THE INVENTION

The present invention concerns a method for controlling a hydraulic system, particularly of a mobile working machine, with at least one internal combustion engine driving at least one hydraulic pump with adjustable volumetric displacement and possibly additional fixed-displacement pumps.

BACKGROUND OF THE INVENTION

A method for controlling the load limit of a hydrostatic drive and a hydrostatic drive for a machine are described in EP 0 497 293 A1. It detects the position of the accelerator and the actual speed of the internal combustion engine present in the machine by means of metrological instruments and feeds these measured values to an electronic control system. A standard deviation is determined from the difference between the actual and target power levels defined by the measured values and a control valve actuated so that the hydraulic pump accepts hydraulic power lower than or equal to the available power of the internal combustion engine. The swivel angle of the hydraulic pump which varies as a function of the system pressure is not itself compensated, but only the change in the speed of the internal combustion engine thus arising, as an input variable for the control system is compensated.

This method of control displays a series of disadvantages. The control system can only allow for one load-dependent reduction in the speed of the internal combustion engine which has already taken place. In addition, the method described only allows for the pump for the hydraulic drive of the self-propelled machine. Other hydraulic loads are ignored in the calculation of the power data. Complicated load distributions and changes in them during operation, as commonly occur in complex hydraulic systems with multiple pumps and transmission systems, cannot be controlled satisfactorily by the method described.

The other load limit control systems known in the state of the art display similar shortcomings. The arrangement for operating a diesel-hydraulic transmission system known from DE 36 11 533 C1 uses a microprocessor controller to reduce the available hydraulic power in the event of thermal and/or mechanical overload of the diesel engine. However, it is necessary for the speed of the diesel engine to have fallen already so that the mechanical overload can be detected. In addition, if several adjustable pumps are present, their volume displacement will always be reduced uniformly, rendering flexible adjustment to different operating modes of the plant impossible.

The necessity for a so-called inching pedal constitutes a further disadvantage in modern machines. This may be separate or linked to the brake pedal and is used to increase the speed of the internal combustion engine independently of the speed of travel. In this way, the speed of the diesel engine can be increased when travelling slowly or standing still, in order to make additional power available to the pumps for further hydraulic functions, e.g. the lifting or working hydraulic systems. However, this complicates the operating procedure for the machine, as the operator has to ensure a diesel engine speed high enough to supply the respective hydraulic systems manually, by operating the inching and accelerator pedals, as well as operating the controls for the working functions.

The purpose of this invention is therefore to avoid the above-mentioned disadvantages and to provide a versatile, simple control method for self-propelled machines with several hydraulically-operated functions, the operation of which is simplified by comparison with systems currently common.

The invention achieves this by the method for controlling a hydraulic system, particularly of self-propelled machine with at least one internal combustion engine driving at least one hydraulic pump with adjustable volumetric displacement and possibly additional fixed-displacement pumps, described in claim 1, whereby:

- the speed of the internal combustion engine is detected by a metrological instrument;
- a the difference in pressure and the volumetric displacement of at least one hydraulic pump with adjustable volumetric displacement is determined by at least one measurement unit;
- the power available from the internal combustion engine is determined from the speed measured;
- the power consumed by each hydraulic pump with adjustable volumetric displacement is determined from the difference in pressure measured, the volumetric displacement and the speed;
- so that the volumetric displacement of at least one hydraulic pump with adjustable volumetric displacement is controlled by a control system so that the total power consumed by at least one hydraulic pump with adjustable volumetric displacement is lower than or equal to the power available from the internal combustion engine or the power delivered or is restricted by the pump, if applicable, in the case of energy recovery at the hydraulic pump.

The balance of power of the entire system can be determined with great accuracy because not only the speed of the diesel engine but also the difference in pressure and the volumetric displacement of the adjustable hydraulic pumps are measured. It is no longer necessary to detect the excess power delivered by a prior reduction in the speed of the diesel engine. On the contrary, the precise power consumption by each pump can be determined from the difference in pressure measured and the current volumetric displacement, and compared in the control device with the power known to be available from the internal combustion engine from the speed measured. The volumetric displacement of the adjustable pumps can thus be reduced before a reduction in the speed of the diesel engine in such a way that the total power consumed by the hydraulic pumps is always lower than or equal to the power delivered by the internal combustion engine. In this way, the engine can be prevented from stalling, even if there is a sudden increase in the load. An optimum internal combustion engine speed for the respective operating mode can be maintained, which improves the energy efficiency of the whole machine.

A further embodiment of the method is characterized in that the power consumed by each of the fixed-displacement pumps driven by the internal combustion engine is approximated from the speed of the drive by calculation and possibly the system pressure measured, and added to the total power consumed.

This renders it possible to integrate further fixed-displacement pumps driven by the internal combustion engine into the calculation of the hydraulic power delivered. Such fixed-displacement pumps are frequently present in common self-propelled machines, e.g. to operate the low-pressure system or for hydraulically-driven cooling fans, etc. Unlike the currently widespread failure to allow for these pumps, approximation by means of a speed-dependent value and allowance being made for it by the control system for the whole system response is advantageous. An even more precise estimate of the power consumed by calculation from the current system pressure produces a highly accurate balance of power at the drive train. This leads to safe operation of the machine in all its modes, as no hydraulic loads are ignored in the calculation of power, It is advantageous if the calculation of the power of the internal combustion engine and/or the hydraulic pumps with adjustable volumetric displacement and/or the hydraulic fixed-displacement pumps takes place by means of stored effective relationships, particularly in the form of characteristic curves or families of characteristics. The driving torque accepted by the appropriate pump can be calculated accurately from the data measured, such as volumes displaced, differences in pressure, etc by means of previously-stored effective relationships. A balance of torque or power balance of the transmission system can be produced from the relationship between speed and the torque generated by the internal combustion engine. Allowance for changes in these effective relationships, e.g. due to symptoms of ageing or the replacement of individual components, can be made easily by appropriate changes to the control software.

If several hydraulic pumps with adjustable volumetric displacement are present, it is practical to set the volumetric displacement of the individual hydraulic pumps using stored control relationships, particularly for prioritizing individual hydraulic pumps. This allows the behavior of the machine to be adapted to a very wide range of use. In this way, the machine's hydraulic systems can be given priority over the transmission simply by adjusting the control relationships, whereby there is no need for the reduction to take place in all the pumps uniformly, but the working function can be given preference at the expense of the drive speed. This improves the overall behavior and ease of use of the system, and may enhance safety, as sufficient power for hydraulic circuits with a safety role can always be made available.

It may be advantageous for a control command from an operator to be detected by at least one input device, particularly an accelerator pedal and/or a joystick. In addition, if several hydraulic pumps with adjustable volumetric displacement are present, it may be advantageous for the volumetric displacement of these individual hydraulic pumps to be adjusted in an order of priority, allowing for the operators control commands.

Load distribution corresponding to the wishes of the operator may be obtained by allowing for the operator's control commands, such as, for example, the accelerator position. The power of the internal combustion engine can thus be fed to the transmission system for preference, if the accelerator pedal is strongly depressed. Analogously, the supply pumps of the machine's hydraulic systems can be taken into account to a greater extent than the other transmission systems and any necessary reduction in the power consumed be made in the other pumps in the case of high target settings for the machine's hydraulic system.

Another embodiment of the invention anticipates that the control system controls the power delivered or made available by the internal combustion engine by influencing its speed, in addition to adjusting the power consumed by the hydraulic pumps with adjustable volumetric displacement. In this way, operation of the machine can be controlled across wide ranges and the inching pedal may be waived. If the power made available by the internal combustion engine is insufficient for the calculated power delivered, the power of the internal combustion engine can automatically be increased to its maximum before the power consumed by the individual loads has to be reduced. This corresponds precisely to the function of the inching pedal, with which the operator affects this increase in power of the internal combustion engine manually, if he requires more power for a load. This allows the demands on the operator to be reduced and the productivity of the machine to be increased.

A further embodiment of the inventive method is characterized in that the power delivered to the internal combustion engine is integrated into the calculation of total power in operating modes in which a hydraulic pump with adjustable volumetric displacement acts as a drive (energy recovery from potential load and braking energy).

For example, when lowering loads or when the machine is travelling downhill, the respective displacement-controlled hydraulic transmission systems deliver power to the drive train through their pumps, which usually entails an increase in the speed of the internal combustion engine, for which the operator must compensate by decelerating. Such system modes may be detected by the control system introduced and be considered in the control of the entire system. This power delivered may then either be made available mechanically to another hydraulic load or lead to a reduction in the power provided by the internal combustion engine, which improves the energy efficiency of the overall system. In certain cases, more power can thus be made available to the hydraulic loads than is provided by the internal combustion engine installed in the machine.

It may be advantageous to allow for further measured system states, particularly vehicle speed, position of the machine's hydraulic system and the temperature of the hydraulic fluid, to control the individual hydraulic pumps with adjustable volumetric displacement.

The control system can be matched precisely to the current operating circumstances of the machine by allowing for such additional system static. In this way, the division of power between the individual pumps may be varied as a function of these static. For example, a corresponding prioritization of the transmission system may be achieved when traveling quickly or preference given to the machine's hydraulic system over the transmission system when executing working movements. The control system can also allow for additional hydraulic loads such as cooling fans, etc, depending upon the total power balance and the current temperatures.

A particular embodiment of the method is characterized in that in a case in which a hydrodynamic converter is provided for motive transmission, its power consumption, particularly from a stored speed-torque characteristic, will be calculated by the control system and taken into consideration in the total power calculation. The control system will also take into account if the machine is driven by a hydrodynamic converter instead of by a hydraulic motor with an adjustable pump (hydrostatic transmission). Calculation of the power consumed by the converter will then also take place using a family of characteristics which reflects the behavior of the converter. Allowance can thus be made for such power consumption in calculating the total output and the control system can apply the necessary signals to the appropriate control inputs of the converter transmission system to achieve the desired speed of travel.

The invention also concerns an electronic control system to implement the method according to one of the preceding claims. Such a control system may take the form of various embodiments in order to implement the method described above. Such systems usually consist of individual components, such as processor boards, memory boards, etc, which assume the individual control functions. The system data, the individual families of characteristics and power characteristics of the individual components can be changed by parameterization of the components and replaced if necessary, leading to a reduction in costs and improved efficiency of the whole system.

DETAILED DESCRIPTION OF THE EXEMPLARY EMBODIMENTS

Figure 1:
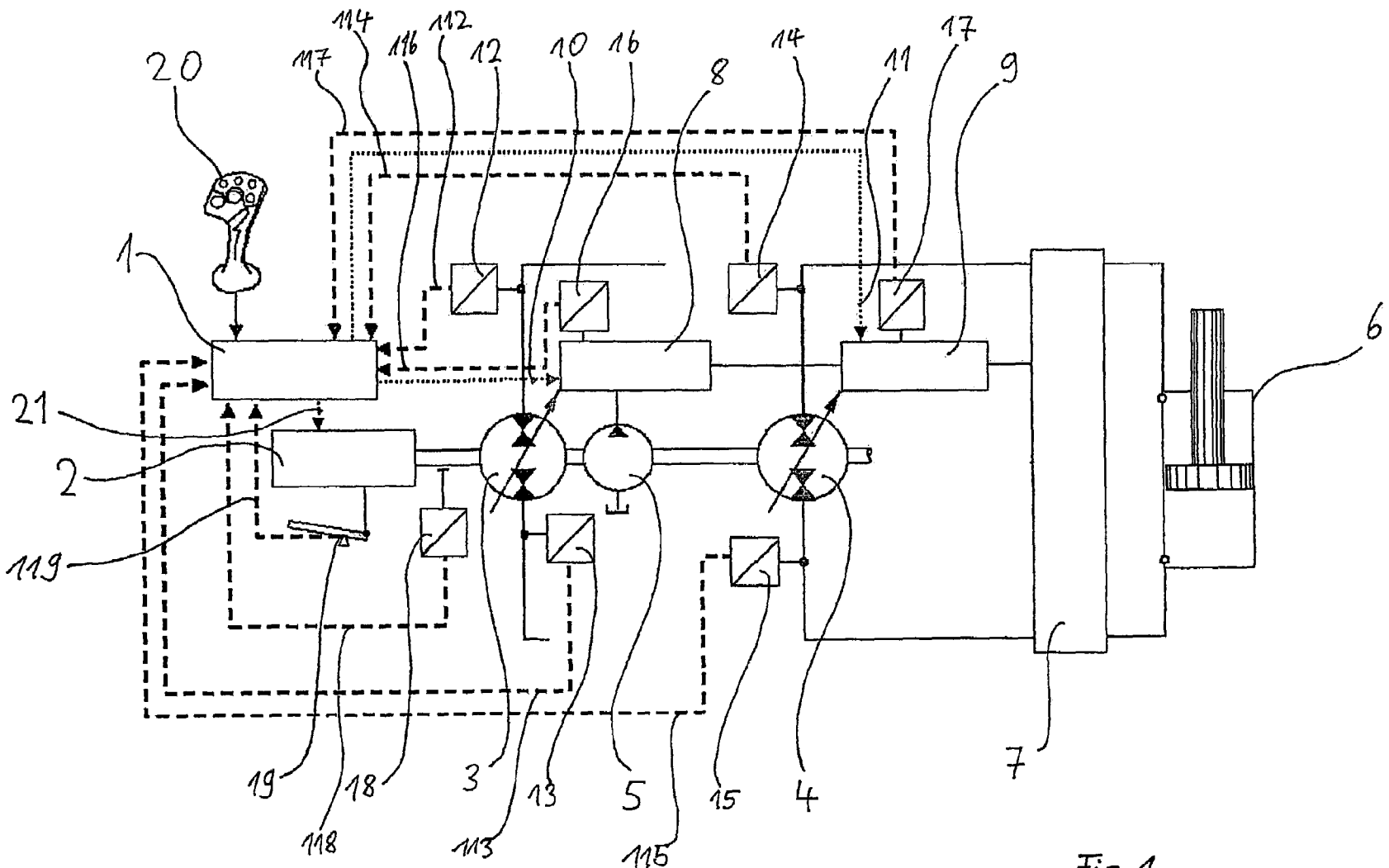
FIG. 1 shows a schematic diagram of an inventive hydraulic system.

Referring to FIG. 1, the electronic control system designated 1 is used to control a hydraulic system of a self-propelled working machine. This hydraulic system has an internal combustion engine 2, which drives two pumps with adjustable volumetric displacement 3 and 4 and a fixed-displacement pump 5 in an initial configuration. The adjustable pump 3 is used to drive a hydraulic transmission system with a rotary engine (not shown in more detail here). The adjustable pump 4 drives a displacement-controlled machine hydraulic system with a differential cylinder 6 as a linear motor. A valve manifold 7 (not shown in more detail) ensures the necessary compensation for the difference in volumetric flow and the other necessary hydraulic functions such as overload protection, etc. The fixed-displacement pump 5 and an accumulator charging circuit (not shown in more detail) form the low-pressure system of the machine and supply low pressure to the hydraulically-operated volumetric displacement adjustment systems 8 and 9, inter alia.

If the adjustable pump 3 is of axial piston swash plate design, the adjustment system 8 is used to adjust the pump swash plate and thus to adjust the volumetric displacement continuously to a maximum limit in both directions of displacement, thus controlling the behavior of the hydraulic rotary motor connected to the pump. The electrical setting signal fed through the control lead 10 is converted into the corresponding position of the swash plate by an electro-hydraulic valve.

The adjustment system 9 for the second hydraulic pump 4 has an analogous structure, in which the signal on control lead 11 is converted into a corresponding position of the swash plate of pump 4. Alternative forms of pump, e.g. radial piston versions, etc, are actuated by analogous electro-hydraulically operated adjustment systems.

Adjustable pump 3 has a pressure sensor with a measured value transducer 12 or 13 at each of its connections, which measures the pressure in this pump connection and transmits the signal to the control system 1. Transmission of the signal is in the form of an analog or digital voltage signal, either over a dedicated signal lead 112 or 113 or over a system bus to which a variety of control system components is connected.

The second adjustable pump 4 also possesses pressure sensors 14 and 15 at both its connections with signal leads 114 and 115. Both adjustment systems 8 and 9 for the adjustable pumps 3 and 4 each have a measurement sensor with a transducer 16 or 17 which measures the current position of the respective pump volumetric adjustment and sends it to the control system through lead 116 or 117. The current volumetric displacement of the respective adjustable pump can be derived from this signal.

Internal combustion engine 2 is fitted with a speed sensor 18 which transmits the current engine speed to the control system 1 through signal lead 118.

The accelerator pedal 19, which controls the supply of fuel to the internal combustion engine, also has a sensor, so that the current position of the accelerator pedal is transmitted to the control system 1 through lead 119. A joystick 20 is used to enter a number of further control signals from the operator in the control system, from which the target position of the plant hydraulic system is determined, inter alia.

A power balance of the entire drive train is continuously determined in the control system 1. For this purpose the power consumption of each individual pump is calculated from the available sensor data and compared with the power provided by the internal combustion engine 2. Should a discrepancy exist, the corresponding control signals for adjustable pumps 3 and 4 or the internal combustion engine 2 will subsequently be generated and their power consumption or power delivery thus adjusted. Quasi-continuous behavior of the entire system is achieved by cyclical repetition of the individual measurement, calculation and control actions.

To calculate the power available from the internal combustion engine 2, the power delivered is calculated from the speed measured by sensor 18 and transmitted to the control system 1 through control lead 118 using a speed-power curve of the internal combustion engine stored in the control system 1.

The current volumetric displacement of the pump 3 is calculated from the position signal of the volumetric adjustment measured by the sensor 16 and sent to the control system through signal lead 116 for the power consumed by pump 3, The current volumetric flow through the pump is determined in conjunction with the speed of the engine, which corresponds to the pump speed in this case, measured by sensor 18 and sent to the control system through the leads 118. The two sensors 12 and 13 transmit the current pressure on both sides of the pump through the signal leads 112 and 113. The difference in pressure generated by the pump can be calculated from these readings. The mechanical power currently consumed by the pump is calculated from the volumetric flow, the difference in pressure and the characteristic curve of the pump stored in the control system 1. Allowance will also be made for any power provided by the transmission pump to the drive shaft, e.g. when traveling downhill, as a reverse difference in pressure at the same speed indicates such a mode (motor operation of the pump).

The power for the additional adjustable pump 4 is calculated analogously. The actual signal of the volumetric displacement generated by the volumetric displacement adjustment system 9 and transmitted to the control system 1 by the sensor 17 through lead 117 is used, in conjunction with the speed measured, to determine the current volumetric flow, from which the power currently consumed by the adjustable pump 4 is calculated in conjunction with the difference in pressure measured by the sensors 14 and 15 and sent through signal leads 114 and 115. A characteristic curve present in the control system and which reflects the behavior of the pump in different operating modes is used for this purpose. If higher demands are made on accuracy, more complicated characteristic curves are used here, which reflect the deviating behavior of the pump at different speeds, pressures or volumes displaced. Allowance for different pumps which are used depending upon the demands made on the plant or replacement of pumps due to maintenance work, etc. can thus be made by simple changes to the characteristic curve or families of characteristics stored in the control system.

The power consumed by the fixed-displacement pump 5 is approximated by its characteristic curve and the system speed measured by the sensor 18. If greater demands are made on accuracy, a further pressure sensor is used to measure the low pressure supplied by the pump 5.

The total power consumed can be compared with the power delivered by the internal combustion engine 2 by adding the individual power consumption of the pumps 3, 4 and 5 together. Automatic allowance is made here for the operating modes in which one or more of the pumps provides power to the drive train.

The control system 1 now calculates settings or limits for both adjustable pumps 3 and 4, depending upon the operating mode of the engine and from the user commands specified by the operator from the joystick 20 and the accelerator pedal 19, in such a way that the total power consumed by both the pumps is less than or equal to the power delivered by the internal combustion engine. These settings are sent to the volumetric displacement adjustment system 8 or 9 of the adjustable pumps 3 or 4 through the control leads 10 or 11. In addition, the internal combustion engine 2 provides the possibility of controlling its speed by an electronic control input 21. If it is established from the calculation of the power equilibrium that more power is to be taken from the pumps than the internal combustion engine is currently making available, its speed and thus its power are increased to their maximum by means of the electronic control input 21.

The power delivered is divided between the two adjustable pumps 3 and 4 on the basis of the control programs in the control system 1. Different control strategies are possible, depending upon the vehicle mode.

In an initial control program, the engine power is increased until maximum power delivery of the internal combustion engine installed is reached. If the power consumption of (or delivery by) one of the pumps then continues to increase, which may occur without intervention by the user, e.g. when travelling uphill or with an increasing load on the machine's hydraulic system, the volumetric displacement of both pumps 3 and 4 is reduced uniformly by the control system 1 transmitting the volumetric displacement reduction commands to volumetric displacement adjustment systems 8 and 9 through control leads 10 and 11. Should the user order increased power for one of pumps 3 or 4 by means of the accelerator pedal 19 or joystick 20, the corresponding volumetric displacement will not be increased until excess power is available at the other respective pump. This may take place either by means of a corresponding command from the user, by, for example, wishing to reduce the vehicle speed by releasing the accelerator, thus making more power available to the plant hydraulic system, or by a change in the vehicle mode with no action on the part of the user, e.g. due to the commencement of travel downhill or relief of the machine's hydraulic system.

For example, there is also an alternative program for particularly fuel-efficient operation of the machine, in which the power from the internal combustion engine is not increased to its maximum before the pump swivels back, but remains in the range of maximum fuel efficiency over as wide a range as possible.

Figure 2:
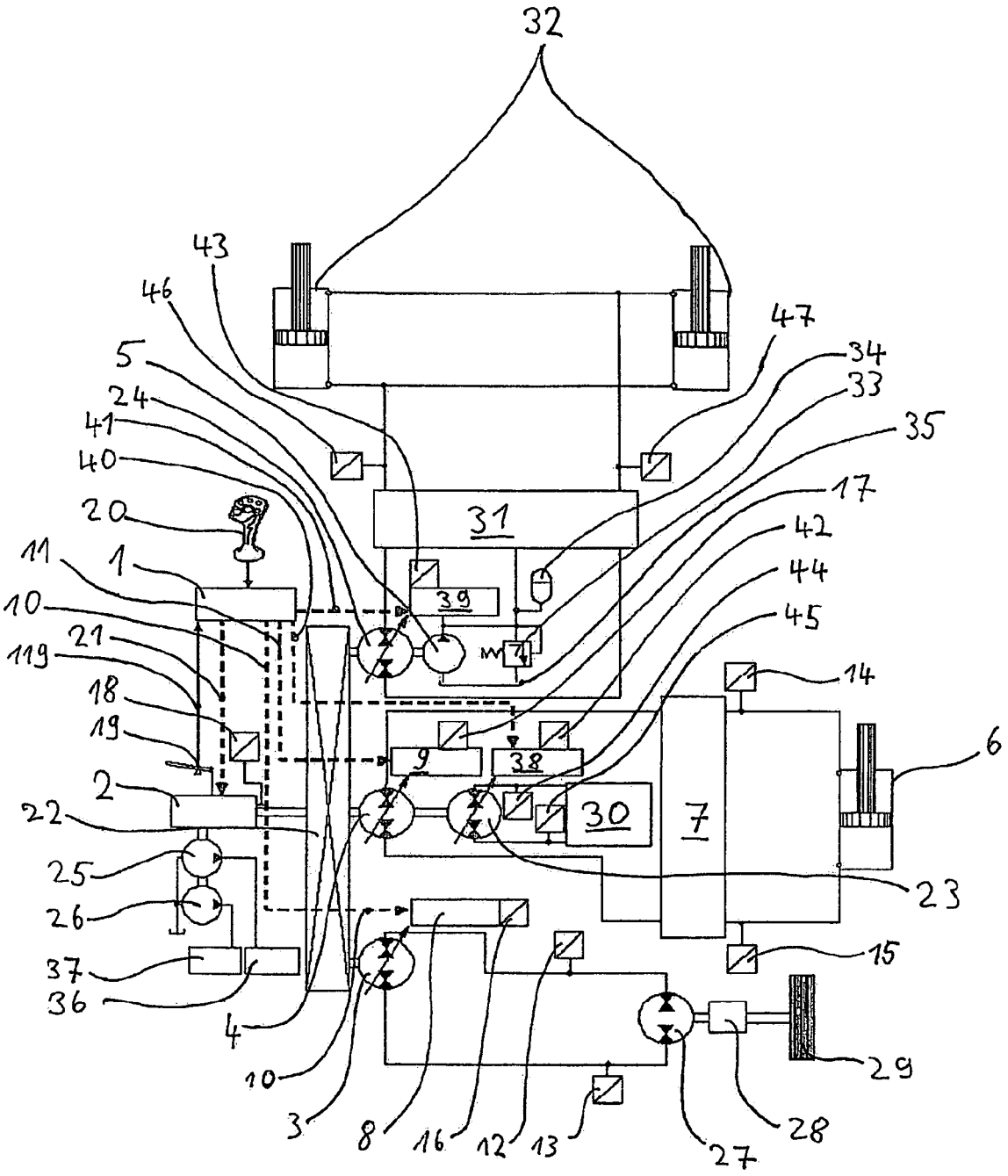
FIG. 2 shows a schematic diagram of an inventive hydraulic system with additional hydraulic components.

The hydraulic system of the machine with a wide functional range is shown in more detail in FIG. 2. An internal combustion engine 2 is again present, which drives four pumps with adjustable volumetric displacement 3, 4, 23, 24 and a fixed-displacement pump 5 through a gearbox 22. In addition, two further fixed-displacement pumps 25 and 26 are driven directly from the secondary take-off of the internal combustion engine 2.

The adjustable pump 3 is in a closed circuit with the hydraulic rotary engine 27, which is connected to the drive train 29 of the vehicle through a gearbox 28. This unit forms the hydrostatic transmission of the machine.

The adjustable hydraulic pump 4 is connected as above with a valve manifold 7 (not shown in more detail) in a closed circuit with the differential cylinder 6, which operates the tipping functions of the machine.

The adjustable pump 23, which is driven together with the adjustable pump 24, is used to operate a hydraulic steering system 30 (not shown in more detail here). Both everyday hydraulic steering systems and steering systems in a closed hydraulic circuit, in which the steering transmission systems are moved directly by the pump volumetric flow can be used. The adjustable pump 24 is connected to the valve manifold 31 in a closed circuit with both differential cylinders 32, which are used to drive the lifting function of the machine. The valve manifold 31 has exactly the same overload protection system as the valve manifold 7, and has other valves which are required for such hydraulic systems. It also compensates for the difference in volumetric flow which is necessary when differential cylinders are used, by compensating for the different volume of the hydraulic fluid, which depends upon the direction of movement of the hydraulic cylinder 32. This consists of fixed-displacement pump 5, which, together with the adjustable pump 24, is driven by the internal combustion engine 2 and the low-pressure relief valve 33, which, in conjunction with the pressure vessel 34 and the hydraulic reservoir 35, ensures that a constant pressure is maintained in the low-pressure system.

The fixed-displacement pump 25 driven directly by the engine is used to operate a hydraulically-driven cooling system 36. The fixed-displacement pump 26 is used to operate the hydraulic brake 37.

The internal combustion engine 2 is controlled by the accelerator pedal 19. It has a speed sensor 18, which transmits the engine speed to the electronic control system 1 through a data lead (not shown in more detail). The accelerator position is also communicated to the electronic control system 1 over the data lead 119. The user can control the remaining responses of the machine from the joystick 20. Each of the adjustable hydraulic pumps 3, 4, 23 and 24 has a volumetric displacement adjustment system 8, 9, 38 and 39 analogous to the above. These accept the setting commands for the respective volumetric displacement from the control system 1 over the signal leads 10, 11, 40 and 41 and adjust the respective pump to the specified setting as a function of the volumetric flow. In this case, this takes place in axial piston swash plate pumps by electro-hydraulic adjustment of the swash plate, thus providing an appropriate volumetric flow.

Each adjustment device 8, 9, 38, 39 has a sensor 16, 17, 42, 43 which transmits the volumetric displacement variable to the control system 1 over the signal leads (not shown in more detail here).

Each of the closed hydraulic circuits with an adjustable pump 3, 4, 23, 24 has two pressure sensors 12, 13, 14, 15, 44, 45, 46, 47, which send the hydraulic pressure upstream and downstream of the adjustable pump to the control system 1 over signal leads (also not shown).

The control method for such machines is, in principle, analogous to that described above. The measured values from the individual sensors are loaded into the control system in cycles. The power currently provided by the Internal combustion engine 2 is calculated using the engine speed of the internal combustion engine 2 in conjunction with its stored characteristic curve, using the engine speed transmitted by the sensor 18. The power of each individual hydraulic pump is calculated and the power data added together to calculate the power consumed by the entire system.

The power consumption for the fixed-displacement pumps 5, 25 and 26 is calculated as a function of the engine speed known from sensor 18 and the known characteristic curve of the pumps. The current power consumption for the pumps with adjustable volumetric displacement 3, 4, 23, 24 is calculated from the volumetric displacements measured, the differences in pressure measured in the respective circuit, the known speed and the stored characteristic curve of the pump. The mechanical power consumed is known by adding all these values together and comparing it with the available power from the internal combustion engine 2.

The fundamental control methods are analogous to those described above. Depending upon the control program set, the control system 1 will increase the speed of the internal combustion engine 2 through the engine control input 21 until it has reached its maximum as the power demanded by the pumps increases. As the entire installed hydraulic power of the machine usually exceeds the power available from the internal combustion engine 2, cases occur in which more power is demanded than the machine can deliver, due to user commands or load states at the hydraulic cylinders 6, 32 or the rotary engine 27. To avoid the reduction in speed which would otherwise occur here, the speed of individual hydraulic pumps 3, 4, 23, 24 is reduced by sending commands for lower settings for the volume displacement to the pump volumetric displacement adjustment systems 8, 9, 38, 39 over the data leads 10, 11, 40, 41.

The control system 1 ensures that the pump 23, which drives the hydraulic steering system 30, is given priority and that the power consumption of the remaining pumps is reduced first. Under normal circumstances, the speed of pump 3, which operates the hydraulic transmission system of the machine, is reduced, in order to make more power available to the machine's hydraulic cylinders 6 and 32. In this case too, the control system 1 will allow for the power which is delivered by the internal combustion engine 2 in special cases, such as movement downhill or when lowering a load through the gearbox 22.

The invention is, of course, not restricted to the above embodiment, but may be modified widely without departing from the basic concept. For example, a transmission system with a torque converter, the speed-torque characteristic of which is stored in the control system in order to calculate its power consumption, may be used instead of the hydrostatic transmission system described.

The invention claimed is:

1. A method for controlling a hydraulic system, particularly of a mobile working machine having at least one internal combustion engine driving at least one hydraulic pump with adjustable volumetric displacement whereby:

the speed of the internal combustion engine is detected by a metrological instrument;

differential pressure and the volumetric displacement of at least one hydraulic pump with adjustable volumetric displacement is determined by at least one measurement unit;

available power from the internal combustion engine is determined from the speed measured;

power consumed by each hydraulic pump with adjustable volumetric displacement is determined from the differential pressure measured, the volumetric displacement, and the speed;

so the volumetric displacement of at least one hydraulic pump with adjustable volumetric displacement is controlled by a control system so that the total power consumed by at least one hydraulic pump with adjustable volumetric displacement is lower than or equal to the power available from the internal combustion engine or the power delivered or is restricted by the pump in a case of energy recovery at the hydraulic pump; and wherein the internal combustion engine drives additional hydraulic fixed-displacement pumps and that the power consumed by each of the fixed displacement pumps is approximated from the speed of the drive by calculation and the system pressure measured, and added to the total power consumed.

2. A method according to claim 1, wherein the calculation of the power of the internal combustion engine, the hydraulic pumps with adjustable volumetric displacement, or the hydraulic fixed-displacement pumps, takes place by means of stored effective relationships, particularly in the form of characteristic curves or families of characteristics.

3. A method according to claim 1, wherein if several hydraulic pumps with adjustable volumetric displacement are present, the volumetric displacement of the individual hydraulic pumps is set or limited using stored control relationships, particularly for prioritizing individual hydraulic pumps.

4. A method according to claim 1, wherein at least one input device, particularly an accelerator pedal or a joystick detects a control command from an operator.

5. A method according to claim 4, wherein if several hydradlic pumps with adjustable volumetric displacement are present, the volumetric displacement of these individual hydraulic pumps is adjusted according to the operator's control commands.

6. An electronic control system to implement the method according to claim 5.

7. A method according to claim 1, wherein the control system controls the power delivered or made available by the internal combustion engine by influencing its speed, in addition to adjusting the power consumed by the hydraulic pumps with adjustable volumetric displacement.

8. An electronic control system to implement the method according to claim 7.

9. A method according to claim 1, wherein the power delivered to the internal combustion engine is integrated into the calculation of total power in operating modes in which a hydraulic pump with adjustable volumetric displacement acts as a drive.

10. A method for controlling a hydraulic system, particularly of a mobile working machine having at least one internal combustion engine driving at least one hydraulic pump with adjustable volumetric displacement whereby:

the speed if the internal combustion engine is detected by a metrological instrument;

differential pressure and the volumetric displacement of at least one hydraulic pump with adjustable volumetric displacement is determined by at least one measurement unit;

available power from the internal combustion engine is determined from the speed measured;

power consumed by each hydraulic pump with adjustable volumetric displacement is determined from the differential pressure measured, the volumetric displacement, and the speed;

the volumetric displacement of at least one hydraulic pump with adjustable volumetric displacement is controlled by a control system so that the total power consumed by at least one hydraulic pump with adjustable volumetric displacement is lower than or equal to the power available from the internal combustion engine or the power delivered or is restricted by the pump, in a case of energy recovery at the hydraulic pump; and wherein that in a case in which a hydrodynamic converter is provided for motive transmission, its power consumption, particularly from a stored speed-torque characteristic, will be calculated by the control system and taken into consideration in the total power calculation.

* * * * *